US012495902B2

(12) United States Patent
Chang

(10) Patent No.: US 12,495,902 B2
(45) Date of Patent: Dec. 16, 2025

(54) SLIDING RAIL ASSEMBLY

(71) Applicant: Nan Juen International Co., Ltd., Taoyuan (TW)

(72) Inventor: Fu-Tien Chang, Taoyuan (TW)

(73) Assignee: Nan Juen International Co., Ltd., Taoyuan (TW)

( * ) Notice: Subject to any disclaimer, the term of this patent is extended or adjusted under 35 U.S.C. 154(b) by 200 days.

(21) Appl. No.: 18/371,418

(22) Filed: Sep. 21, 2023

(65) Prior Publication Data

US 2025/0098857 A1 Mar. 27, 2025

(51) Int. Cl.
*A47B 88/44* (2017.01)
*A47B 88/473* (2017.01)
*A47B 88/493* (2017.01)

(52) U.S. Cl.
CPC ..... *A47B 88/493* (2017.01); *A47B 88/473* (2017.01); *A47B 2210/0081* (2013.01)

(58) Field of Classification Search
CPC ..... A47B 88/40; A47B 88/44; A47B 88/473; A47B 88/493; A47B 2210/0081
USPC ..... 312/334.1, 334.46, 333
See application file for complete search history.

(56) References Cited

U.S. PATENT DOCUMENTS 2,277,702 A * 3/1942 Kennedy ..... A47B 88/49 312/334.46
5,033,805 A * 7/1991 Hobbs ..... A47B 88/493 312/334.46
5,316,389 A * 5/1994 Hoffman ..... A47B 88/493 384/21
6,817,685 B2 * 11/2004 Lammens ..... A47B 88/43 312/334.47
6,935,710 B2 * 8/2005 Chen ..... A47B 88/487 312/334.44
7,364,244 B2 * 4/2008 Sandoval ..... H05K 7/1421 312/334.46
7,726,755 B2 * 6/2010 Peng ..... A47B 88/57 312/334.46
10,791,834 B2 * 10/2020 Chen ..... A47B 88/57

* cited by examiner

*Primary Examiner* — James O Hansen

(57) ABSTRACT

The sliding rail assembly includes an outer rail having a positioning feature, an intermediate rail displaceable relative to the outer rail and having a concave surface facing the positioning feature, a first stopper pivotally connected to the concave surface to correspond to a first side portion of the positioning feature; and an operating device movably connected to the outer rail with a push rod thereof placed in the concave surface and located on one side of the first stopper, so that when the push rod pushes the first stopper along the concave surface, the first stopper is prohibited from blocking the first side portion of the positioning feature.

11 Claims, 15 Drawing Sheets

SLIDING RAIL ASSEMBLY

BACKGROUND OF THE INVENTION

1. Field of the Invention

The present invention relates to a sliding rail assembly, which has an operating device with a push rod for pushing a first stopper along a concave surface of the intermediate rail, so the first stopper does not block a first side portion of a positioning feature of the outer rail.

2. Description of the Related Art

Generally, in the sliding rail assembly used in the server, there is a stopper on the intermediate rail, so that when the intermediate rail extends along the outer rail, the intermediate rail forms a temporary lock with the outer rail through the stopper. When the inner rail is received in the intermediate rail, the inner rail will push the stopper to release the locked state of the intermediate rail and the outer rail. However, when the server is being repaired, it will be removed together with the inner rail. At this time, the intermediate rail cannot be received into the outer rail.

SUMMARY OF THE INVENTION

The present invention has been accomplished under the circumstances in view. It is therefore the main object of the present invention to provide a sliding rail assembly, which has an operating device movably connected to the outer rail with a push rod thereof used to push a first stopper along a concave surface of the intermediate rail, so that the operator can easily release the locked status of the intermediate rail and the outer rail with the operating device.

It is another object of the present invention is to provide a sliding rail assembly, wherein the push rod and the first stopper of the operating device are hidden in the concave surface of the intermediate rail, and the push rod directly pushes the first stopper so that there is no linkage structure between the push rod and the first stopper, which can reduce the manufacturing cost, avoid interlocking failure, and help to thin the slide rail assembly.

For achieving above-mentioned objects, the technical means that the present invention adopts comprises: an outer rail comprising at least one positioning feature; an intermediate rail displaceable relative to the outer rail and comprising a concave surface located on a back side thereof and facing the at least one positioning feature; a first stopper pivotally connected to the concave surface and being able to correspond to a first side portion of the at least one positioning feature; and an operating device movably connected to the outer rail and comprising a push rod that is placed in the concave surface and located on one side of the first stopper, so that when the push rod of the operating device pushes the first stopper along the concave surface, the first stopper is prohibited from blocking the first side portion of the positioning feature.

According to the aforementioned features, the side of the first stopper forms a first slope, and the push rod has a second slope corresponding to the first slope.

According to the aforementioned features, there is a limiting member on the outer rail, and a limiting hole on the operating device, and the limiting hole can be displaced relative to the limiting member.

According to the aforementioned features, the outer rail is provided with an operating hole, and the operating device has an operating portion and an actuating portion extending from the operating portion and displaceable relative to the operating hole, and the push rod is combined with the actuating portion.

According to the aforementioned features, the present invention further comprises a second stopper and an elastic member, wherein the second stopper is pivotally connected to the concave surface and corresponds to the second side portion of the at least one positioning feature; the elastic member has one end thereof connected to the first stopper and an opposite end thereof connected to the second stopper, so that the elastic member is capable of providing an elastic force to the first stopper and the second stopper.

According to the aforementioned features, the intermediate rail further comprises a first hole, a second hole and a third hole; the first stopper comprises a first stop portion located at one side thereof and displaceable relative to the first hole; the second stopper comprises a second stop portion located at one end thereof and displaceable relative to the second hole; the elastic member is located in the third hole for displacement.

According to the aforementioned features, the first stopper further comprises a first hook portion formed on an opposite side thereof and located at the third hole and connected to one end of the elastic member; the second stopper further comprises a second hook portion formed on an opposite end thereof and located at the third hole and connected to an opposite end of the elastic member.

According to the aforementioned features, the present invention further comprises an inner rail displaceable relative to the intermediate rail, the intermediate rail further comprises a fourth hole, and the second stopper further comprises a pushing portion located on a side end thereof and extending from the fourth hole to an opposing front side of the intermediate rail, so that the pushing portion can be pushed to displace relative to the inner rail.

According to the aforementioned features, the outer rail further comprises a positioning seat and a positioning hole, and the positioning seat is fixed to a back side of the outer rail; the at least one positioning feature is formed by bending the positioning seat, and is placed in the positioning hole to protrude to an opposing front side of the outer rail.

According to the aforementioned features, the outer rail further comprises a starting member, and the first stopper comprises a starting surface so configured that when the starting surface abuts against the starting member, the first stopper is started.

According to the aforementioned features, the first stopper further comprises a first locking groove corresponding to the first side portion of the at least one positioning feature; the second stopper further comprises a second locking groove corresponding to the second side portion of the at least one positioning feature.

Based on the aforementioned technical means, the operating device is movably connected to the outer rail, and the first stopper is pushed along the concave surface of the intermediate rail by the push rod of the operating device, and the push rod of the operating device and the first stopper are both hidden in the concave surface of the intermediate rail, and the push rod is used to directly push the first stopper, so that there is no interlocking structure between the push rod and the first stopper. It not only makes it easy for the operator to use the operating device to release the locked state of the intermediate rail and the outer rail, but also reduces manufacturing costs, avoids linkage failure, and helps to thin the slide rail assembly.

DETAILED DESCRIPTION OF THE PREFERRED EMBODIMENT

Figure 1:
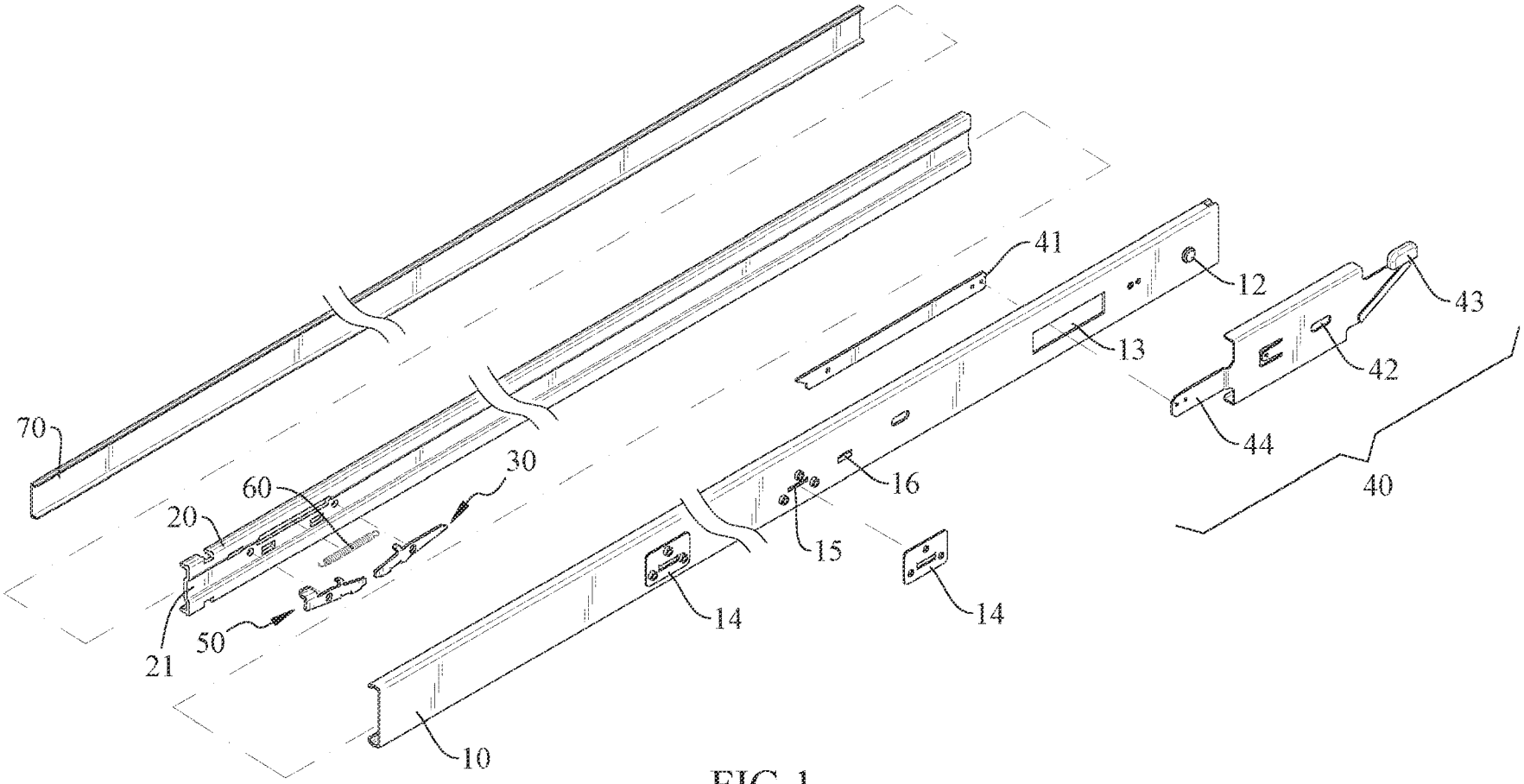
FIG. 1 is an exploded perspective view of the sliding rail assembly of the present invention.
Figure 2:
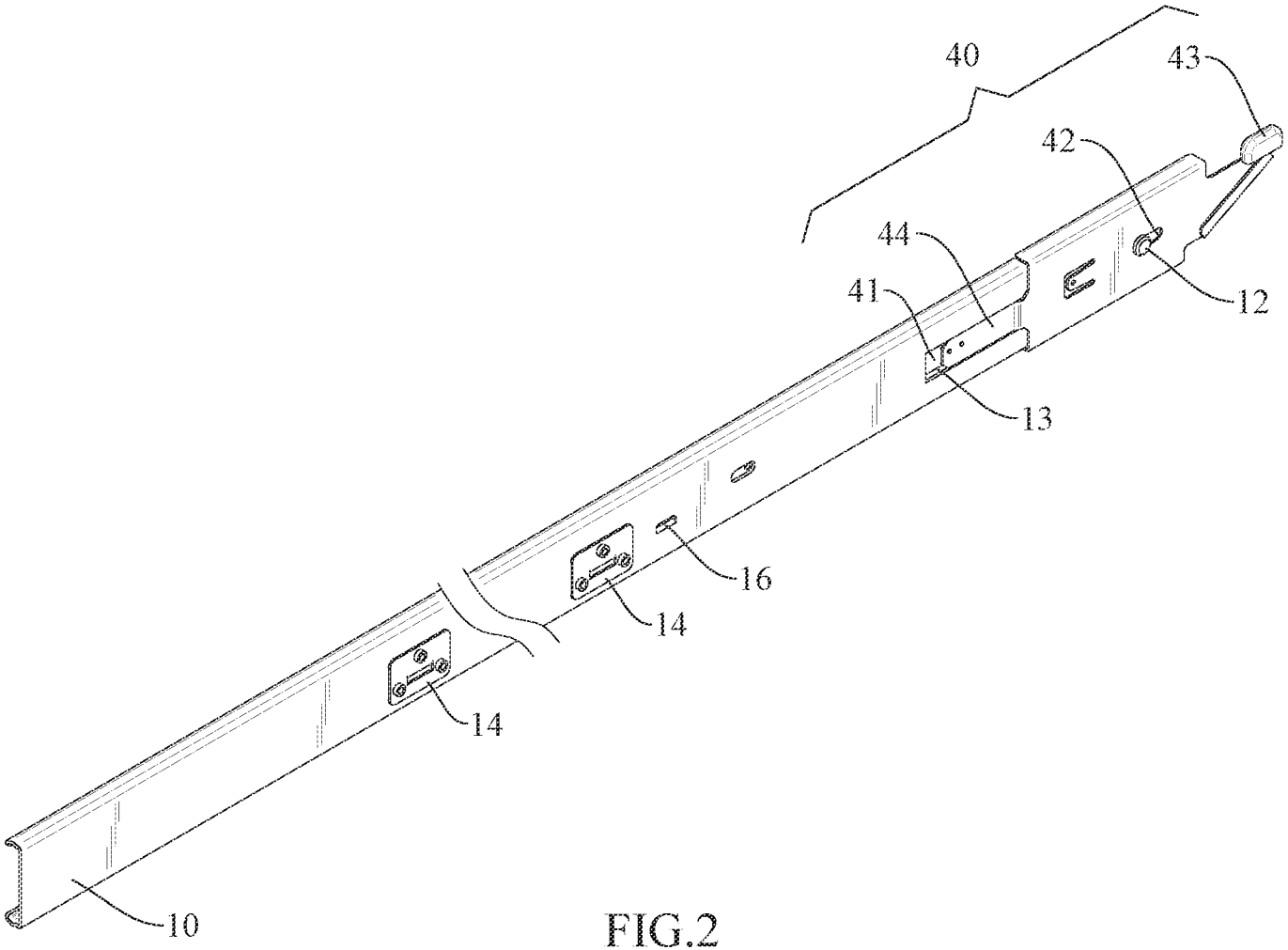
FIG. 2 is a combined perspective view of the sliding rail assembly of the present invention.

As shown in FIG. 1 to FIG. 6C, the present invention is a sliding rail assembly, comprising an outer rail 10, which is provided with at least one positioning feature 11; an intermediate rail 20, which can be displaced relative to the outer rail 10 and has a concave surface 21 located on the back side and facing the positioning feature 11; a first stopper 30 pivotally connected to the concave surface 21 and being able to correspond to a first side portion 111 of the positioning feature 11; and an operating device 40, which is movably connected to the outer rail 10, and has a push rod 41 that is placed in the concave surface 21, so that the push rod 41 is located on one side of the first stopper 30. Thereby, when the push rod 41 of the operating device 40 pushes the first stopper 30 along the concave surface 21, the first stopper 30 does not block the first side portion 111 of the positioning feature 11.

Figure 3A:
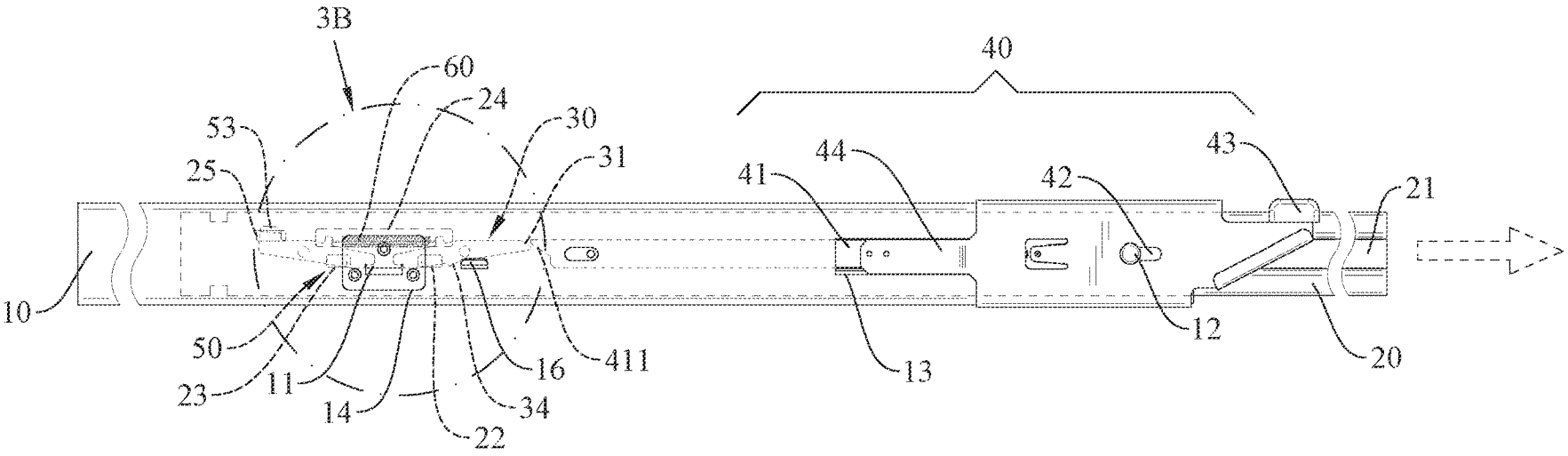
FIG. 3A is a schematic diagram of the positioning feature of the intermediate rail of the present invention with the first stopper and second stopper corresponding to the outer rail.
Figure 4A:
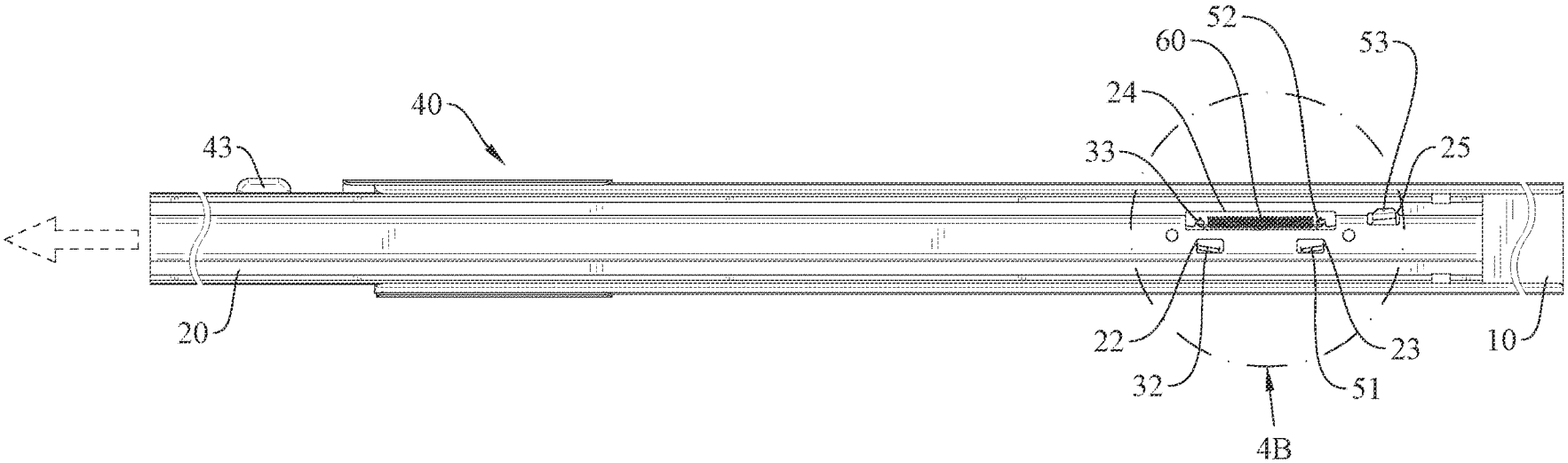
FIG. 4A is a schematic diagram of the intermediate rail temporarily locked to the outer rail by the first stopper and the second stopper in the present invention.
Figure 5A:
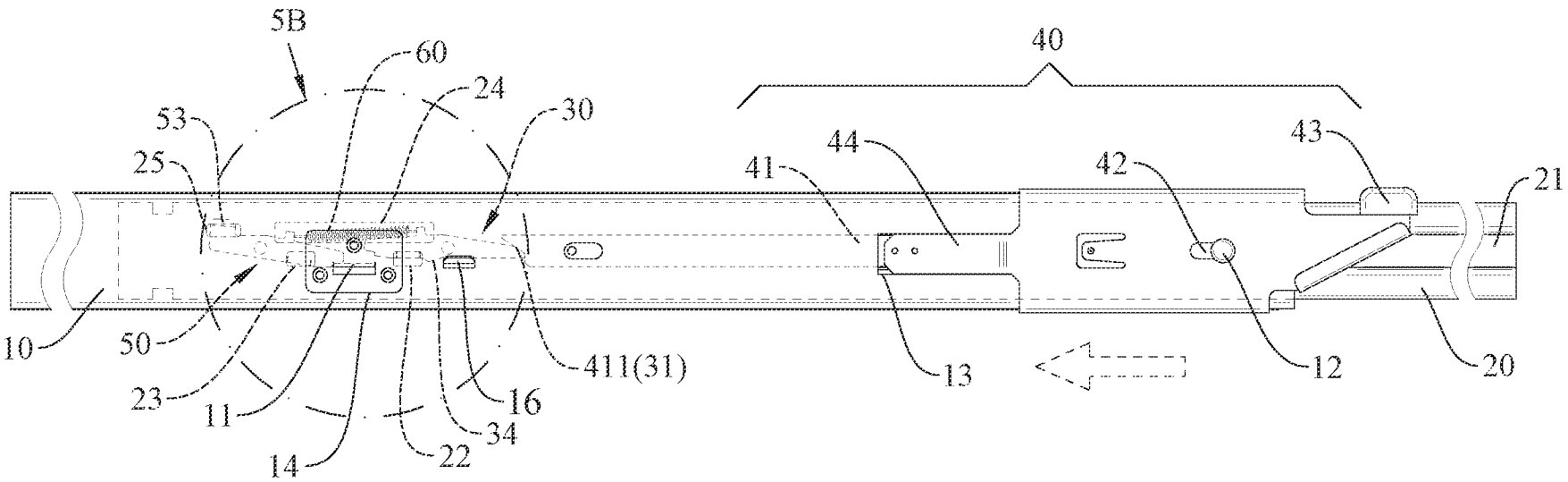
FIG. 5A is a schematic diagram of the operation of the operating device of the present invention on the outer rail.

As shown in FIG. 3A, FIG. 4A and FIG. 5A, in this embodiment, the outer rail 10 is provided with a limiting member 12, and the operating device 40 is provided with a limiting hole 42, the limiting hole 42 can be displaced relative to the limiting member 12, so the limiting member 12 is located in the limiting hole 42, but not limited thereto.

As above, the outer rail 10 is provided with an operating hole 13, and the operating device 40 comprises an operating portion 43 and an actuating portion 44 extending from the operating portion 43. The actuating portion 44 can be displaced relative to the operating hole 13, so the actuating portion 44 is located in the operating hole 13. The push rod 41 is combined with the actuating portion 44. As shown in FIG. 3C and FIG. 5C, one end of the first stopper 30 forms a first slope 31, and the push rod 41 has a second slope 411 corresponding to the first slope 31, but not limited thereto.

Figure 3B:
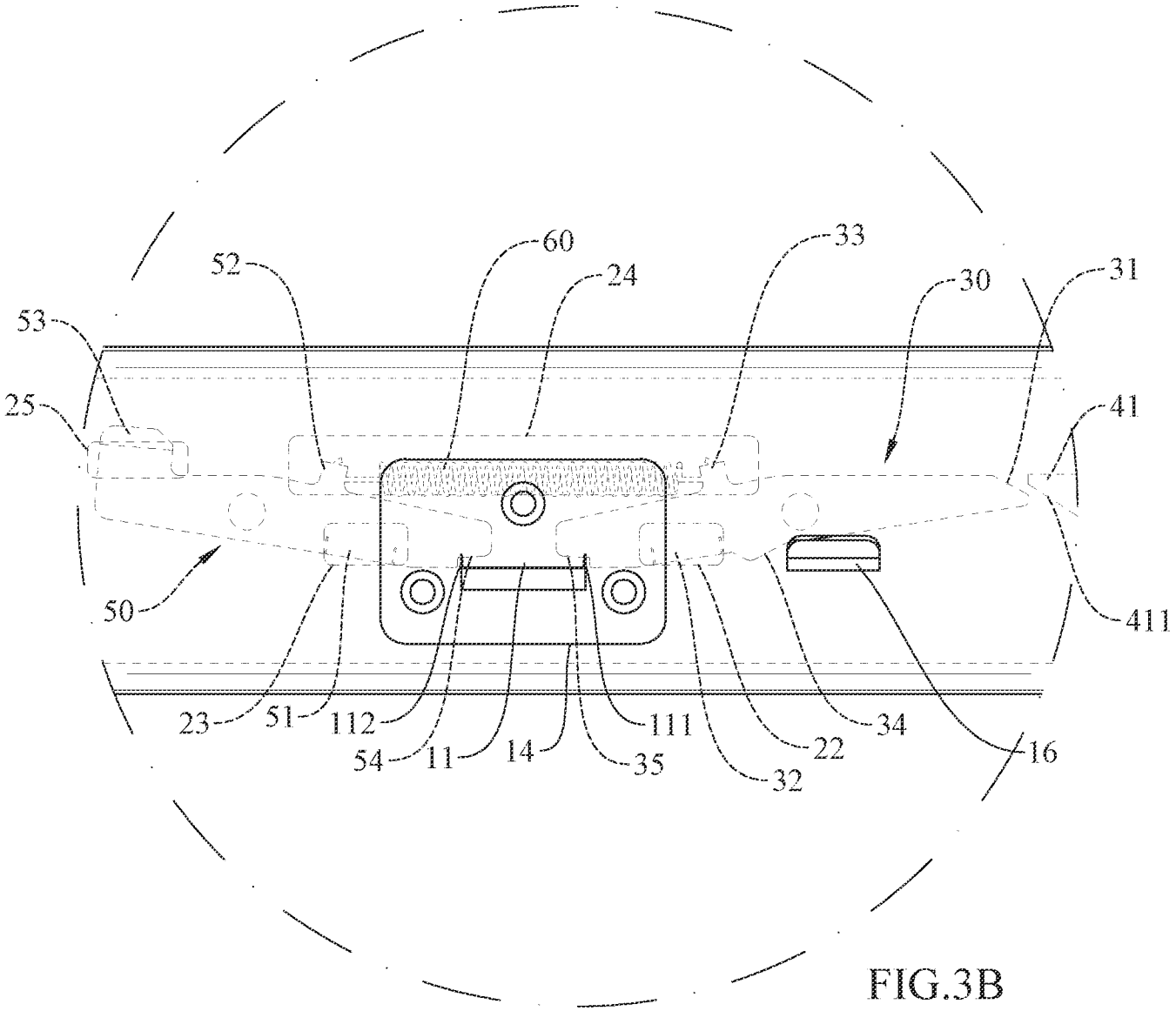
FIG. 3B is an enlarged view of part 3B of FIG. 3A.
Figure 3C:
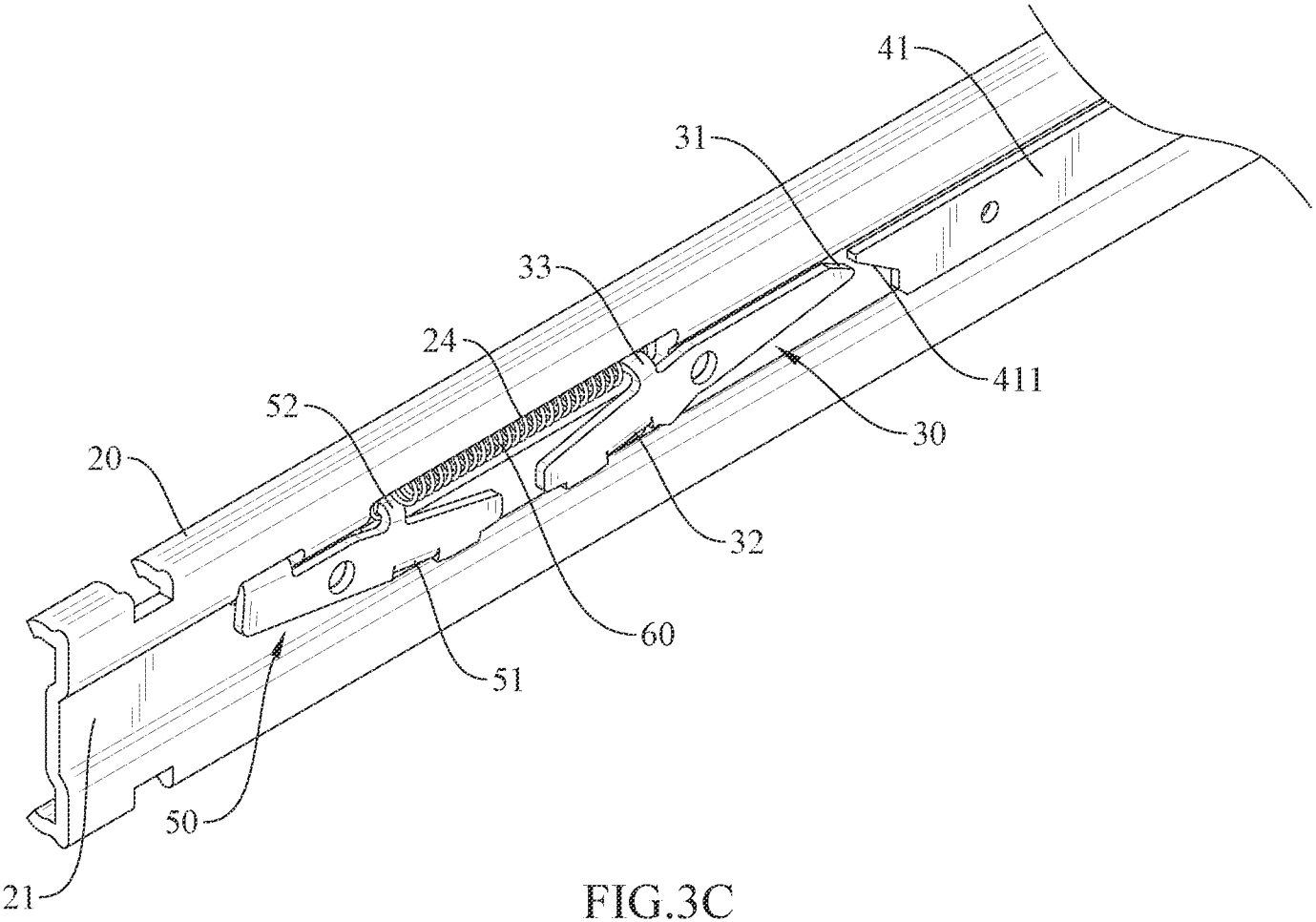
FIG. 3C is a schematic diagram of the push rod of the present invention located on the side of the first stopper.
Figure 4B:
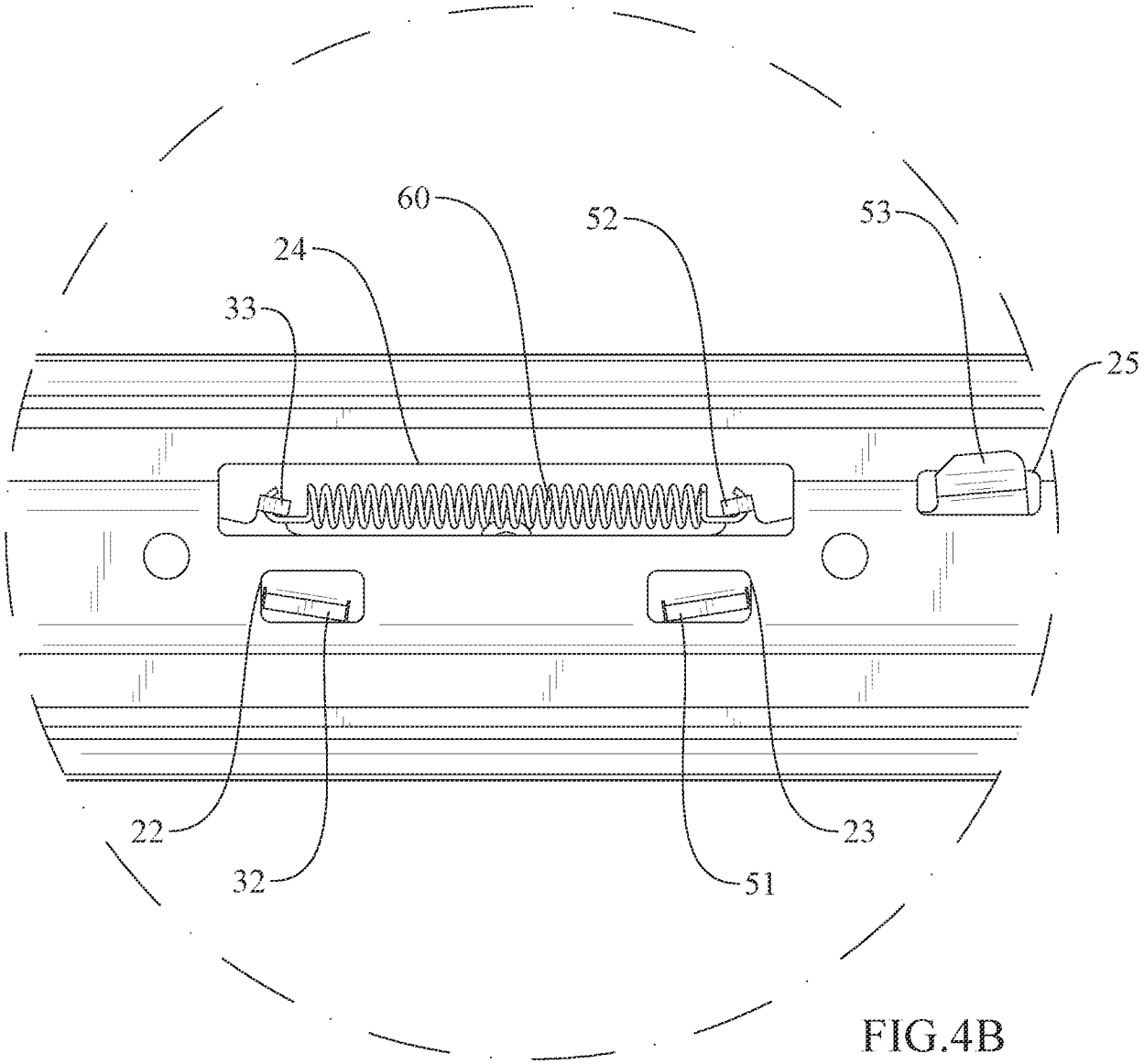
FIG. 4B is an enlarged view of part 4B of FIG. 4A.
Figure 5B:
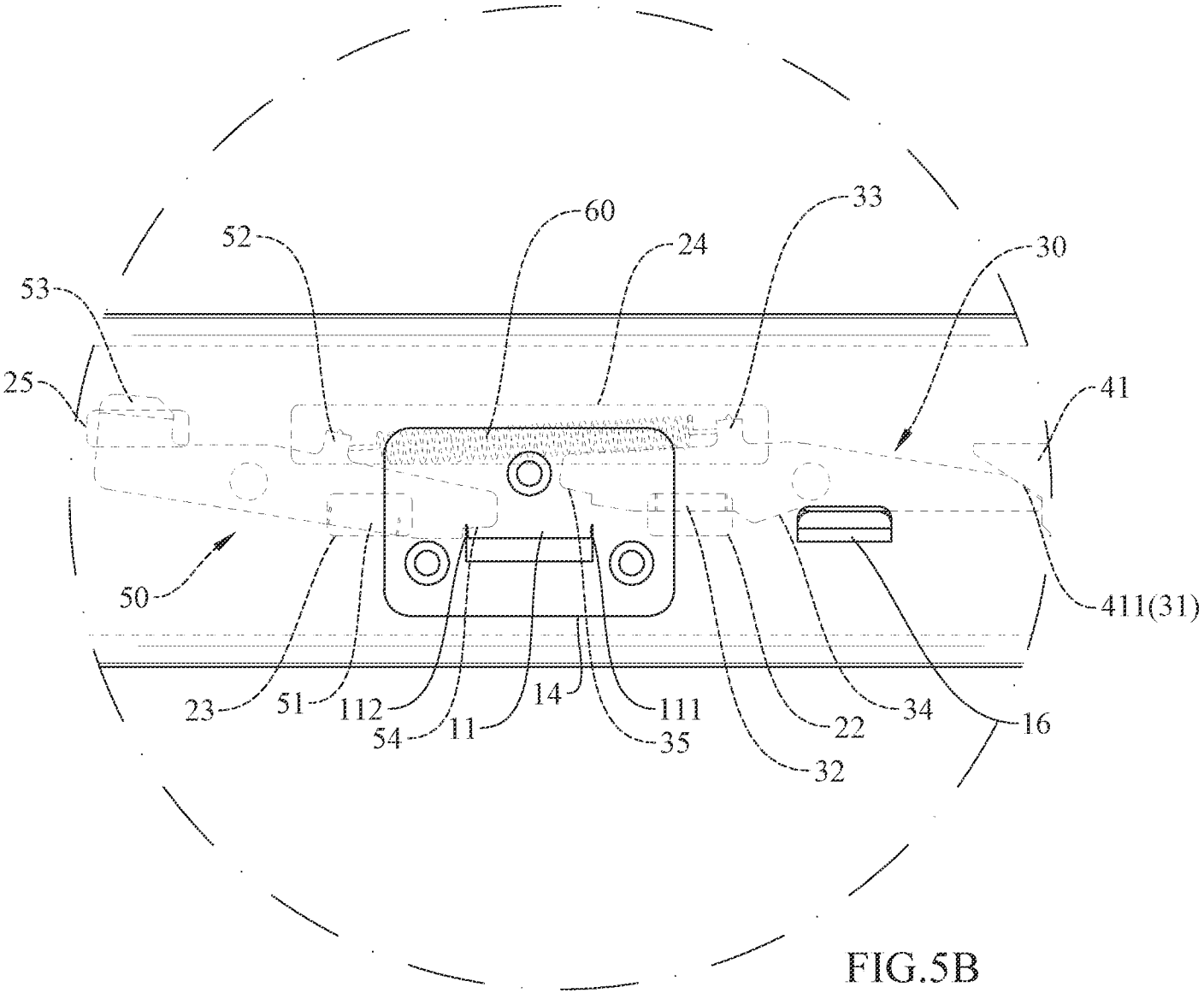
FIG. 5B is an enlarged view of part 5B of FIG. 5A.
Figure 5C:
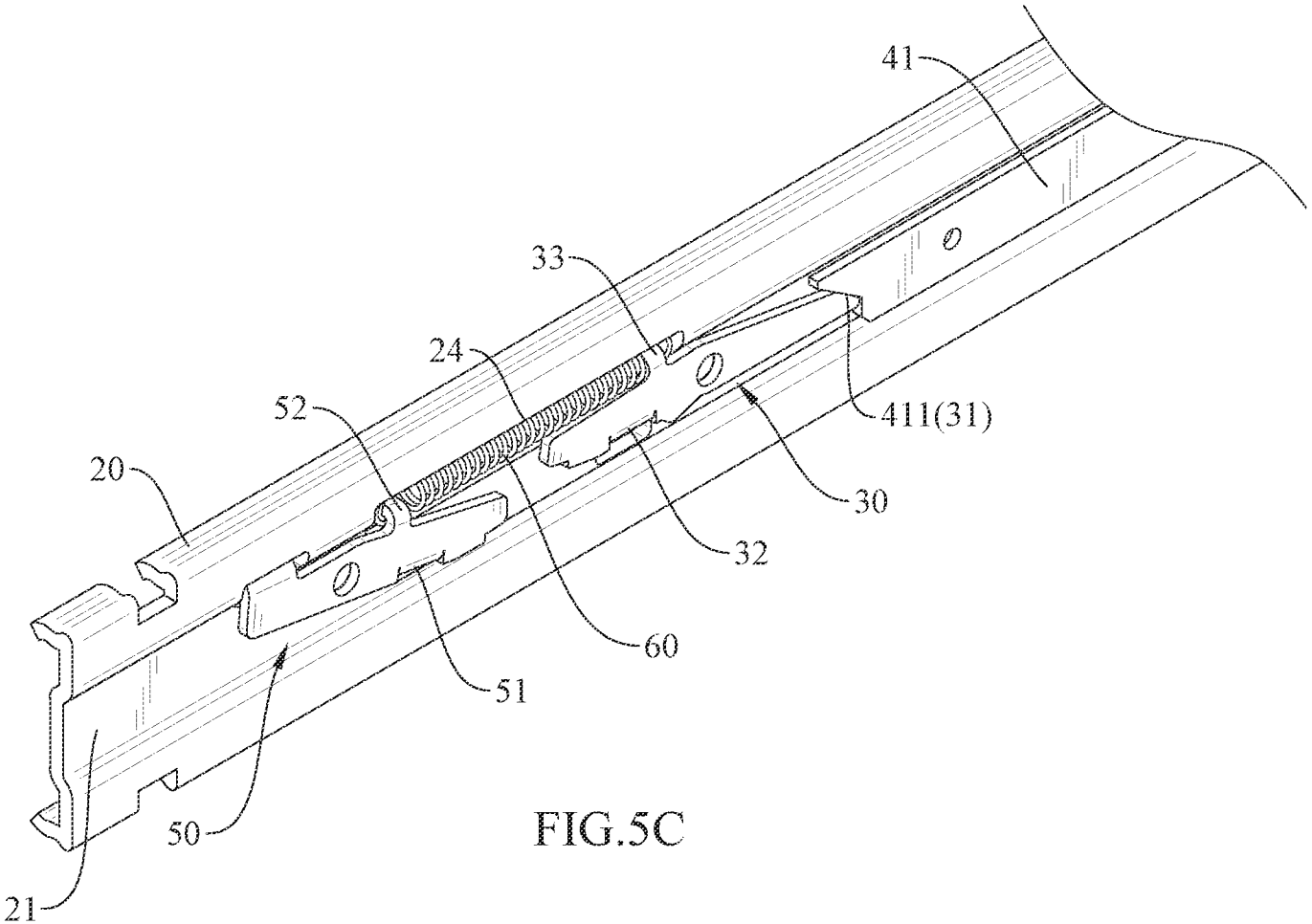
FIG. 5C is a schematic diagram of the push rod of the present invention pushing the first stopper along the concave surface.

As shown in FIG. 3B, FIG. 4B and FIG. 5B, in this embodiment, the sliding rail assembly further comprises a second stopper 50 and an elastic member 60. The second stopper 50 is pivotally connected to the concave surface 21 and can correspond to a second side portion 112 of the positioning feature 11. One end of the elastic member 60 is connected to the first stopper 30 and the other end of the elastic member 60 is connected to the second stopper 50, so that the elastic member 60 can provide elastic force to the first stopper 30 and the second stopper 50, in this embodiment, the elastic element 60 is a spring, but not limited thereto.

As above, the intermediate rail 20 is provided with a first hole 22, a second hole 23 and a third hole 24. One side of the first stopper 30 forms a first stop portion 32 and one end of the second stopper 50 forms a second stop portion 51. The first stop portion 32 can be displaced relative to the first hole 22. The second stop portion 51 can be displaced relative to the second hole 23. The elastic member 60 is located at the third hole 24 for displacement. Therefore, the first stop portion 32 is located in the first hole 22 and the second stop portion 51 is located in the second hole 23. The other side of the first stopper 30 forms a first hook portion 33. The first hook portion 33 is located at the third hole 24 and connected to one end of the elastic member 60. The other end of the second stopper 50 forms a second hook portion 52. The second hook portion 52 is located at the third hole 24 and connected to the other end of the elastic member 60, but not limited thereto.

Please refer to FIG. 1 and FIG. 2 again, the outer rail 10 further comprises a positioning seat 14 and a positioning hole 15, and the positioning feature 11 is formed by bending the positioning seat 14. The positioning feature 11 is placed in the positioning hole 15 and protrudes to the front of the outer rail 10, and the positioning seat 14 is fixed to the back of the outer rail 10, that is, the positioning feature 11 in this embodiment is a bending member extending from the positioning seat 14 through the positioning hole 15 to the front of the outer rail 10, but not limited thereto.

Please refer to FIG. 3A and FIG. 5A again, in this embodiment, the outer rail 10 further comprises a starting member 16, and the first stopper 30 has a starting surface 34. When the starting surface 34 abuts against the starting member 16, the first stopper 30 is started, but not limited thereto.

Please refer to FIG. 3B and FIG. 5B again, in this embodiment, the other side end of the first stopper 30 forms a first locking groove 35 that can correspond to the first side portion 111 of the positioning feature 11, and the other side end of the second stopper 50 forms a second locking groove 54 that can correspond to the second side portion 112 of the positioning feature 11, but not limited thereto.

Figure 5D:
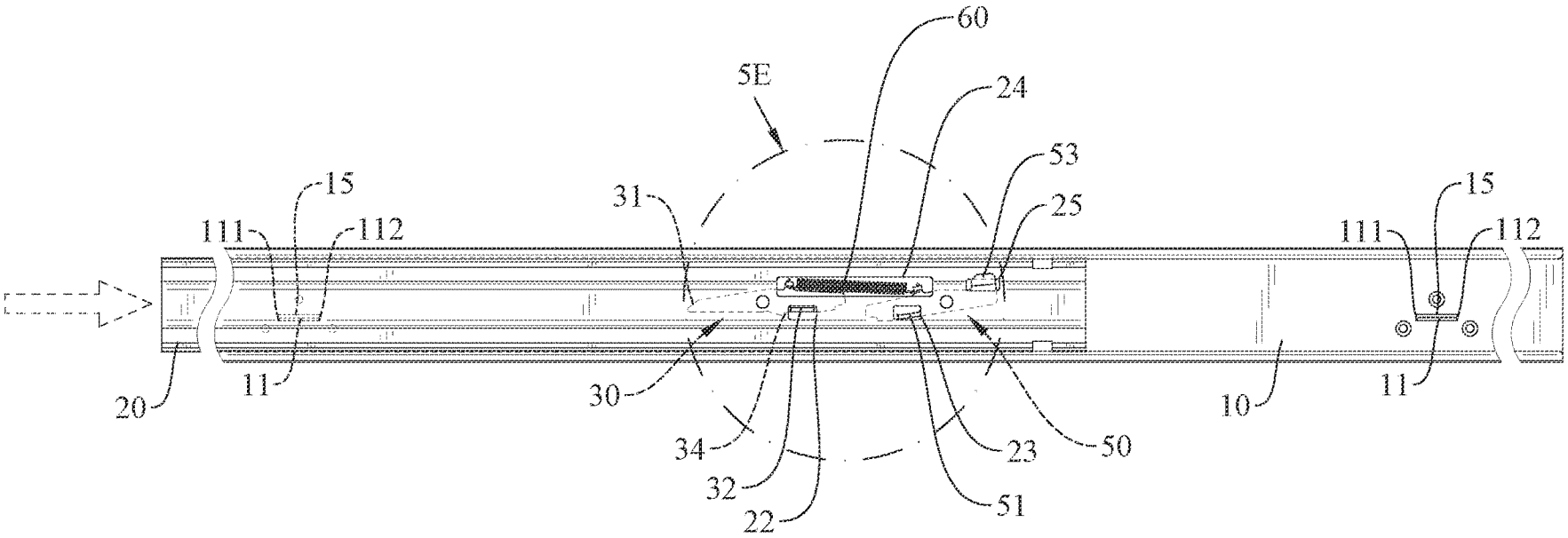
FIG. 5D is a schematic diagram of the present invention that the first stopper does not block the positioning feature and the intermediate rail can be received.
Figure 5E:
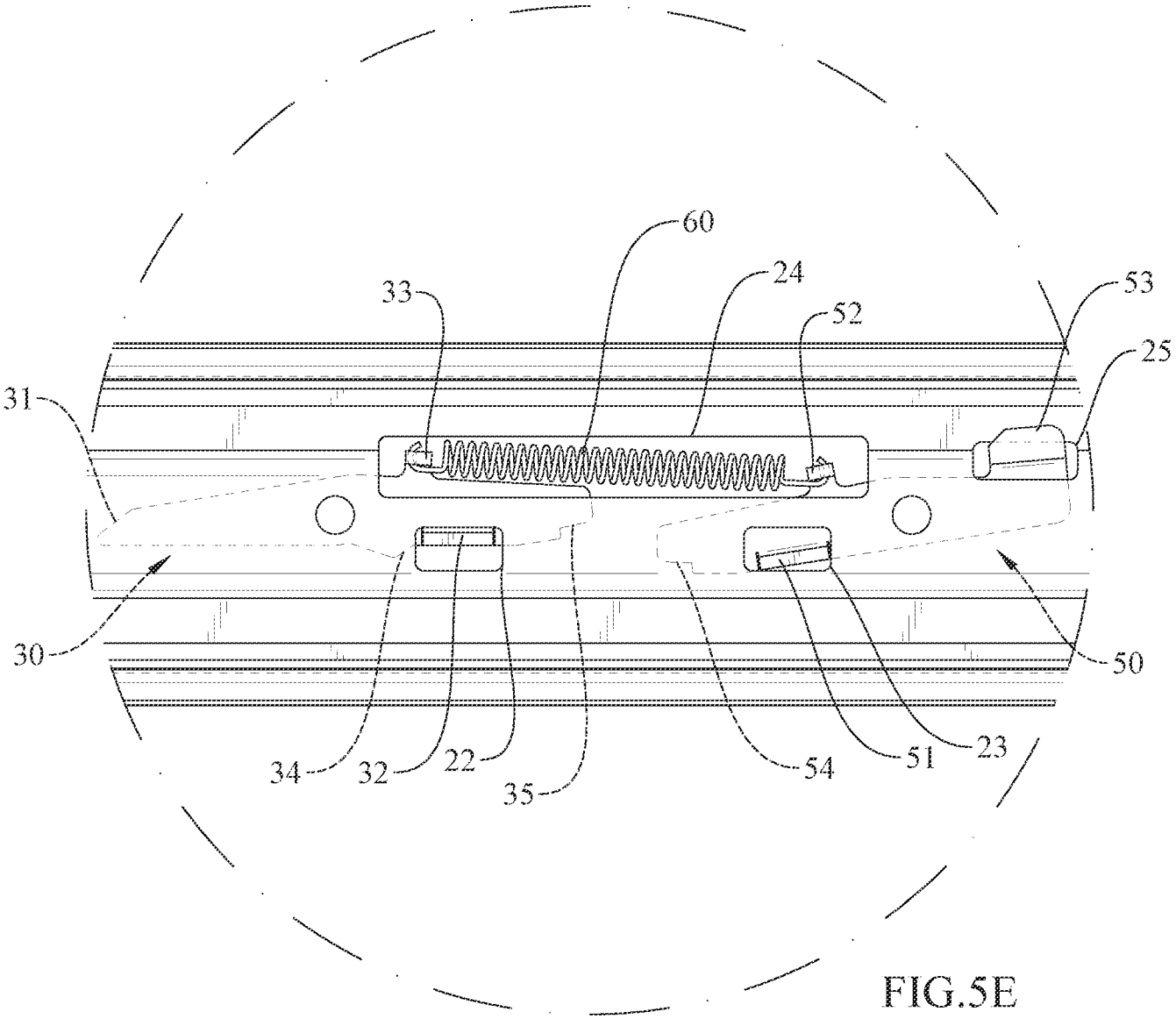
FIG. 5E is an enlarged view of part 5E of FIG. 5D.

As shown in FIG. 5D and FIG. 5E, in this embodiment, the positioning feature 11 can be two, which are arranged in the front section of the outer rail 10, so that the intermediate rail 20 can be extended on the outer rail 10. When the first stopper 30 does not block the first side portion 111 of the positioning feature 11 located in the front section of the outer rail 10, the intermediate rail 20 can be retracted, and it is located in the rear section of the outer rail 10. When the first stopper 30 blocks the first side portion 111 of the positioning feature 11 located at the rear section of the outer rail 10, the intermediate rail 20 can be received in the predetermined position of the outer rail 10, but not limited thereto.

Figure 6A:
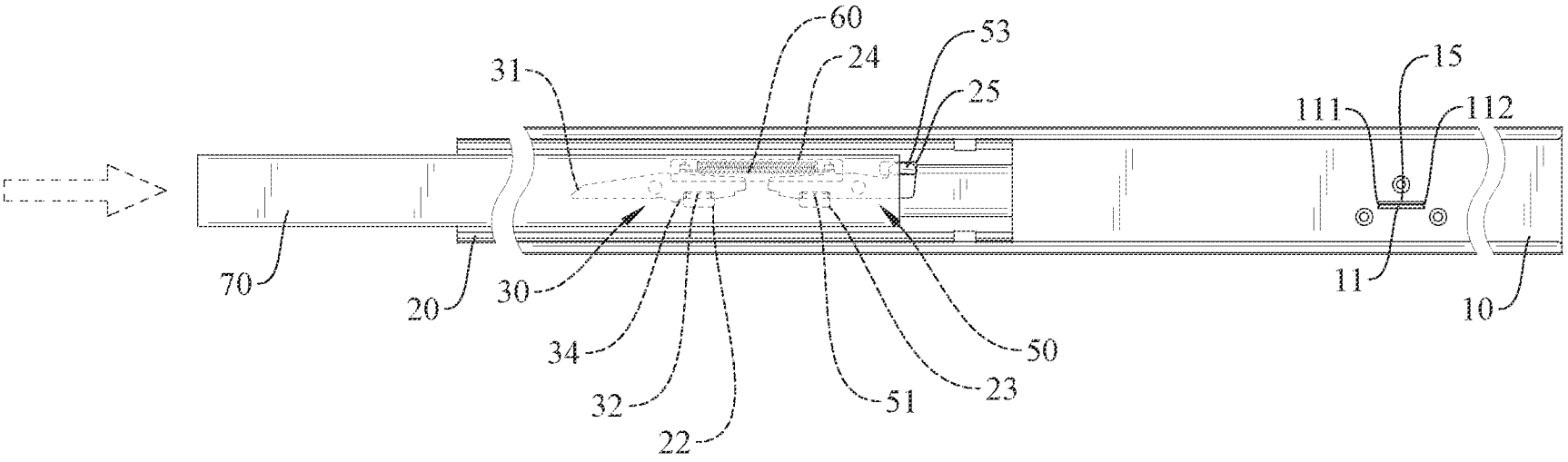
FIG. 6A is a schematic diagram of the pushing portion of the inner rail pushing the second stopper of the present invention.
Figure 6B:
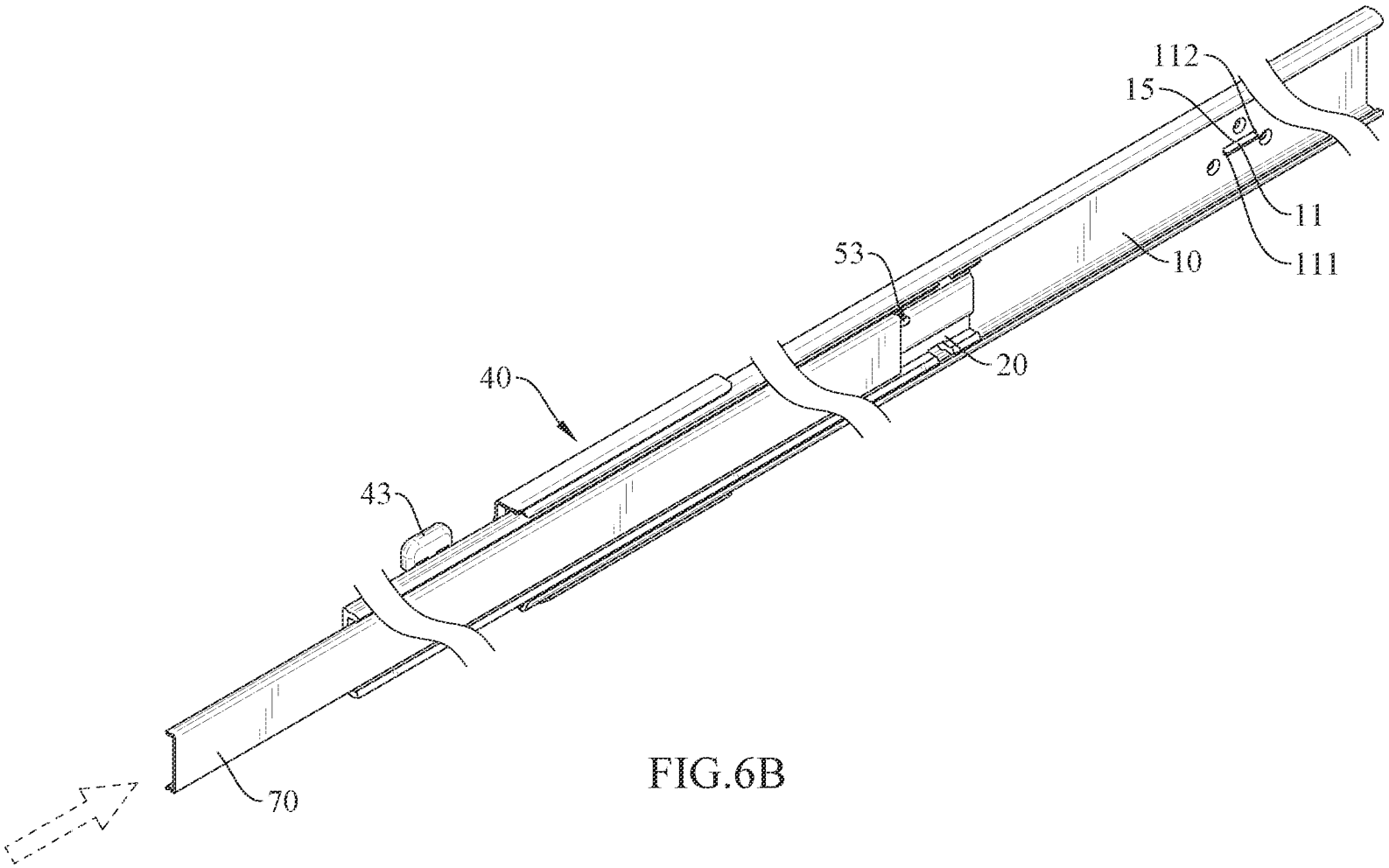
FIG. 6B is an oblique elevational view of the pushing portion of the inner rail pushing the second stopper of the present invention.
Figure 6C:
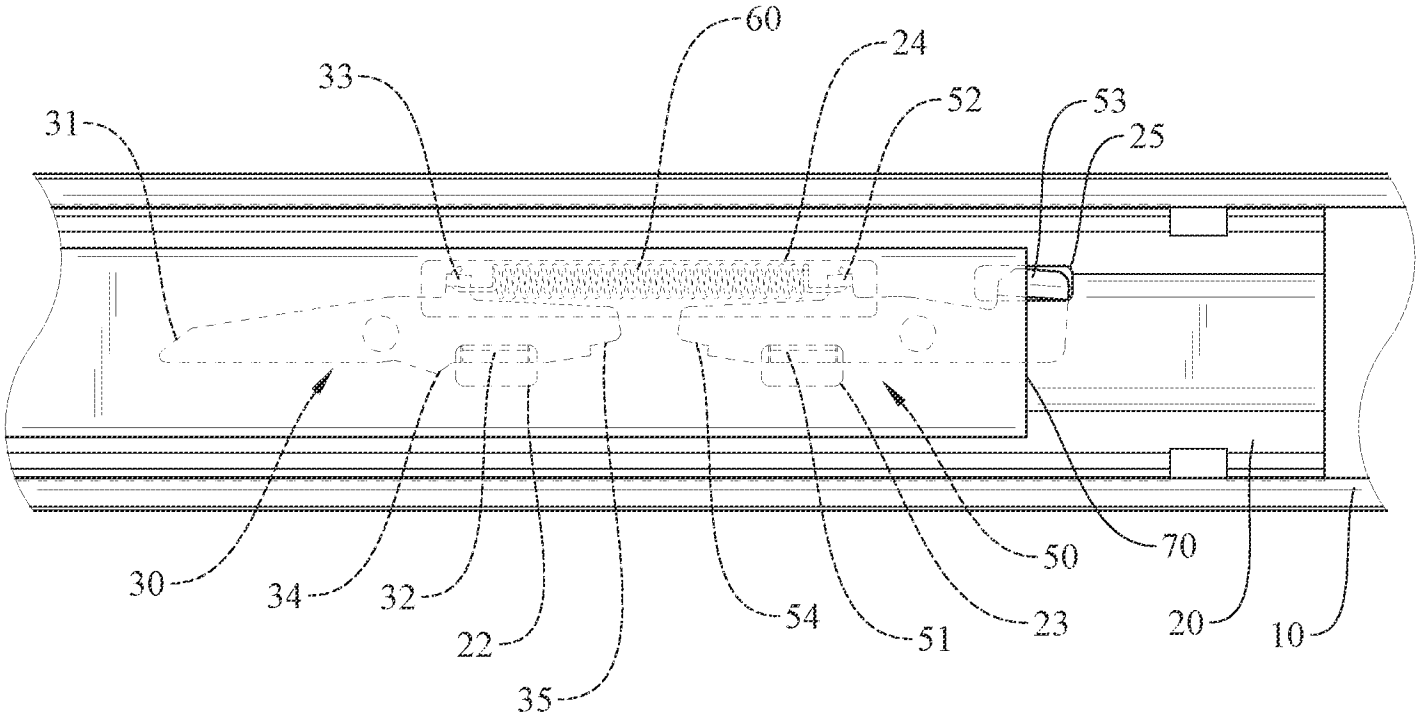
FIG. 6C is a partial schematic diagram of the pushing portion of the second stopper pushed by the inner rail of the present invention.

As shown in FIG. 6A, FIG. 6B and FIG. 6C, the sliding rail assembly further comprises an inner rail 70. The inner rail 70 can be displaced relative to the intermediate rail 20. The side end of the second stopper 50 forms a pushing portion 53, and the intermediate rail 20 is provided with a fourth hole 25. The pushing portion 53 extends from the fourth hole 25 to the front of the intermediate rail 20, so that the pushing portion 53 can be pushed relative to the inner rail 70.

Based on such a structure, the operating device 40 is movably connected to the outer rail 10, and the first stopper 30 is pushed along the concave surface 21 of the intermediate rail 20 by the push rod 41 of the operating device 40, and the push rod 41 of the operating device 40 and the first stopper 30 are both hidden in the concave surface 21 of the intermediate rail 20, and the push rod 41 is used to directly push the first stopper 30, so that there is no interlocking structure between the push rod 41 and the first stopper 30. It not only makes it easy for the operator to use the operating device 40 to release the locked state of the intermediate rail 20 and the outer rail 10, but also reduces manufacturing costs, avoids linkage failure, and helps to thin the slide rail assembly.

What claimed is:

1. A sliding rail assembly, comprising:

an outer rail comprising at least one positioning feature, said at least one positioning feature comprising a first side portion and an opposing second side portion;

an intermediate rail displaceable relative to said outer rail, said intermediate rail comprising a concave surface located on a back side thereof and facing said at least one positioning feature;

a first stopper pivotally connected to said concave surface and being able to correspond to and engage with said first side portion of said at least one positioning feature; and an operating device movably connected to said outer rail, said operating device comprising a push rod, said push rod being disposed in said concave surface and located on one side of said first stopper, so that when said push rod of said operating device pushes said first stopper along said concave surface, said first stopper is pivoted to prevent engagement with said first side portion of said positioning feature.

2. The sliding rail assembly as claimed in claim 1, wherein said first stopper comprises a first slope located on a side end thereof, and said push rod comprises a second slope corresponding to said first slope.

3. The sliding rail assembly as claimed in claim 1, wherein said outer rail is provided with a limiting member, and said operating device comprises a limiting hole displaceable relative to said limiting member, so said limiting member is located in said limiting hole.

4. The sliding rail assembly as claimed in claim 1, wherein said outer rail further comprises an operating hole; said operating device further comprises an operating portion and an actuating portion extending from said operating portion, said actuating portion being displaceable relative to said operating hole; said push rod is combined with said actuating portion.

5. The sliding rail assembly as claimed in claim 1, further comprising a second stopper and an elastic member, said second stopper being pivotally connected to said concave surface and corresponding to said second side portion of said at least one positioning feature, said elastic member having one end thereof connected to said first stopper and an opposite end thereof connected to said second stopper, so that said elastic member is capable of providing an elastic force to said first stopper and said second stopper.

6. The sliding rail assembly as claimed in claim 5, wherein said intermediate rail further comprises a first hole, a second hole and a third hole; said first stopper comprises a first stop portion located at one side thereof and displaceable relative to said first hole;

said second stopper comprises a second stop portion located at one end thereof and displaceable relative to said second hole; said elastic member is located in the third hole for displacement.

7. The sliding rail assembly as claimed in claim 6, wherein said first stopper further comprises a first hook portion formed on an opposite side thereof and located at said third hole and connected to one end of said elastic member; said second stopper further comprises a second hook portion formed on an opposite end thereof and located at said third hole and connected to an opposite end of said elastic member.

8. The sliding rail assembly as claimed in claim 5, further comprising an inner rail displaceable relative to said intermediate rail, wherein said intermediate rail further comprises a fourth hole; said second stopper further comprises a pushing portion located on a side end thereof, said pushing portion extending from said fourth hole to an opposing front side of said intermediate rail, so that said pushing portion is able to be pushed to displace relative to said inner rail.

9. The sliding rail assembly as claimed in claim 5, wherein said first stopper further comprises a first locking groove corresponding to said first side portion of said at least one positioning feature; said second stopper further comprises a second locking groove corresponding to said second side portion of said at least one positioning feature.

10. The sliding rail assembly as claimed in claim 1, wherein said outer rail further comprises a positioning seat and a positioning hole, said positioning seat being fixed to a back side of said outer rail; said at least one positioning feature is formed by bending said positioning seat, and is placed in said positioning hole to protrude to an opposing front side of said outer rail.

11. The sliding rail assembly as claimed in claim 1, wherein said outer rail further comprises a starting member, and said first stopper comprises a starting surface se configured to abut against said starting member.

* * * * *